US006304037B1

(12) United States Patent
Hsieh

(10) Patent No.: US 6,304,037 B1
(45) Date of Patent: Oct. 16, 2001

(54) LIGHT CONTROL WITH OVERLOAD/ SHORT-CIRCUIT PROTECTION CIRCUIT MEANS

(76) Inventor: Frank Hsieh, No. 103, Ta Feng Rd., Sheng Kang Hsiang, Taichung Hsien (TW)

( * ) Notice: Subject to any disclaimer, the term of this patent is extended or adjusted under 35 U.S.C. 154(b) by 0 days.

(21) Appl. No.: 09/627,493

(22) Filed: Jul. 28, 2000

(51) Int. Cl.[7] ..... G04B 49/06; F24H 3/02

(52) U.S. Cl. ..... 315/119; 417/44.1; 392/361; 318/16

(58) Field of Search ..... 315/112–119, 225, 315/362; 392/361–367; 417/44.1, 42, 44.11; 340/825.57–825.6

(56) References Cited

U.S. PATENT DOCUMENTS 4,818,920 * 4/1989 Jacob ..... 318/16
5,668,920 * 9/1997 Pelonis ..... 392/361
5,738,496 * 4/1998 Mehta ..... 417/44.1

* cited by examiner

*Primary Examiner*—David Vu
*Assistant Examiner*—Wilson Lee
(74) *Attorney, Agent, or Firm*—Pro-Techtor International Services

(57) ABSTRACT

A light control installed in a ceiling fan and lamp assembly and adapted to control the light intensity of lamp means of the ceiling fan and lamp assembly, the light control having an overload/short circuit protection circuit formed of an amplifier and a comparator and adapted to automatically cut off power supply from the ceiling fan and lamp assembly upon an overload or short-circuit.

2 Claims, 3 Drawing Sheets

LIGHT CONTROL WITH OVERLOAD/ SHORT-CIRCUIT PROTECTION CIRCUIT MEANS

BACKGROUND OF THE INVENTION

The present invention relates to a light control for use with a ceiling fan and lamp assembly to control the light intensity of the lamp of the ceiling fan and lamp assembly, and more particularly to such a light control, which has protection circuit means that automatically cut off power supply from the lamp upon an overload or short-circuit.

Varieties of ceiling fan and lamp assemblies have been disclosed, and have appeared on the market. A ceiling fan and lamp assembly is generally equipped with a light control for controlling the light intensity of the lamp. FIG. 1 shows a prior art light control for this purpose. This structure of light control 10 comprises a TRIAC 11, a transistor 12, and a CPU (central processing unit) 20. The transistor 12 is connected between the CPU 20 and the gate of the TRIAC 11. The other two terminals of the TRIAC 11 are respectively connected to the lamp 30 and the hot wire for controlling the phase of the lamp 30. When an input pulse width Tr is connected to the TRIAC 11, the gate current is produced at the gate of the TRIAC 11, causing the TRIAC 11 to change its connected phase angle, so as to further switch on/off the lamp 30, or regulate the light intensity of the lamp 30. This design is functional, however the TRIAC 11 may be damaged or caused to burn when an overload or short-circuit occurs.

SUMMARY OF THE INVENTION

The invention has been accomplished to provide a light control, which eliminates the aforesaid problem. It is therefore the main object of the present invention to provide a light control for a ceiling fan and lamp assembly, which automatically cuts off power supply from the lamp of the ceiling fan and lamp assembly upon an overload or short-circuit. According to the present invention, the light control comprises a CPU (central processing unit having an input contact and an output contact, a TRIAC, a transistor, an amplifier, and a comparator. The TRIAC has a gate connected to the output contact of the CPU through the transistor, a second terminal connected to the lamp means of the ceiling fan and lamp assembly, and a third terminal connected to the amplifier. The amplifier has an output terminal connected to the comparator. The comparator has a feedback circuit outputted to the input contact of the CPU. When an overload or short-circuit occurs, a potential difference is obtained and compared with the rated value, and the comparison result is fed back to the CPU, causing the CPU to cut off power supply from the TRIAC.

DETAILED DESCRIPTION OF THE PREFERRED EMBODIMENT

Figure 1:
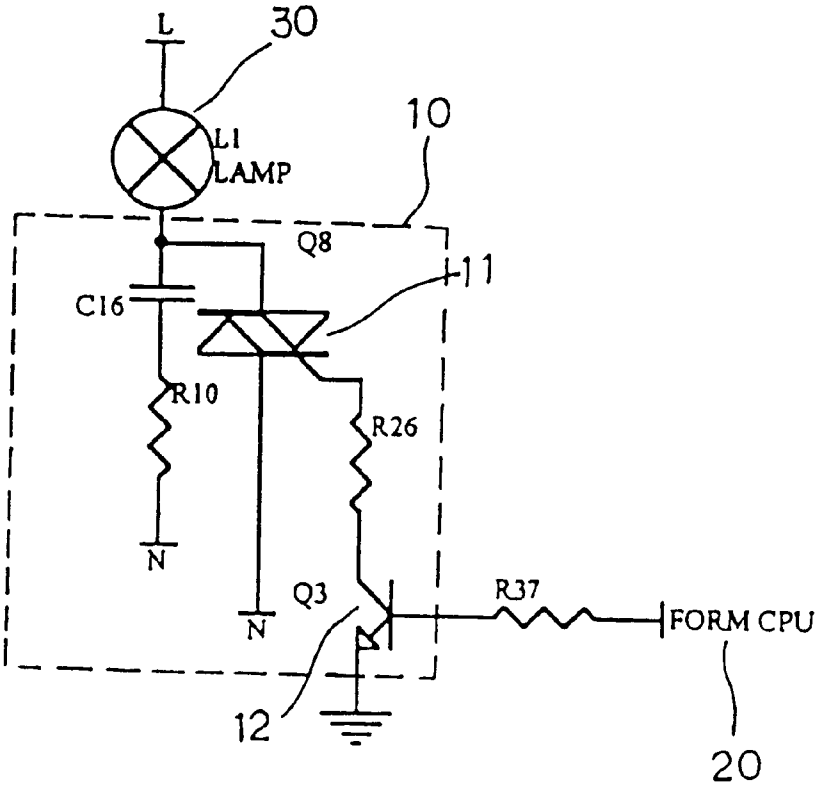
FIG.1(PRIOR ART)
FIG. 1 is a circuit diagram of a light control for a ceiling fan and lamp assembly according to the prior art.
Figure 2:
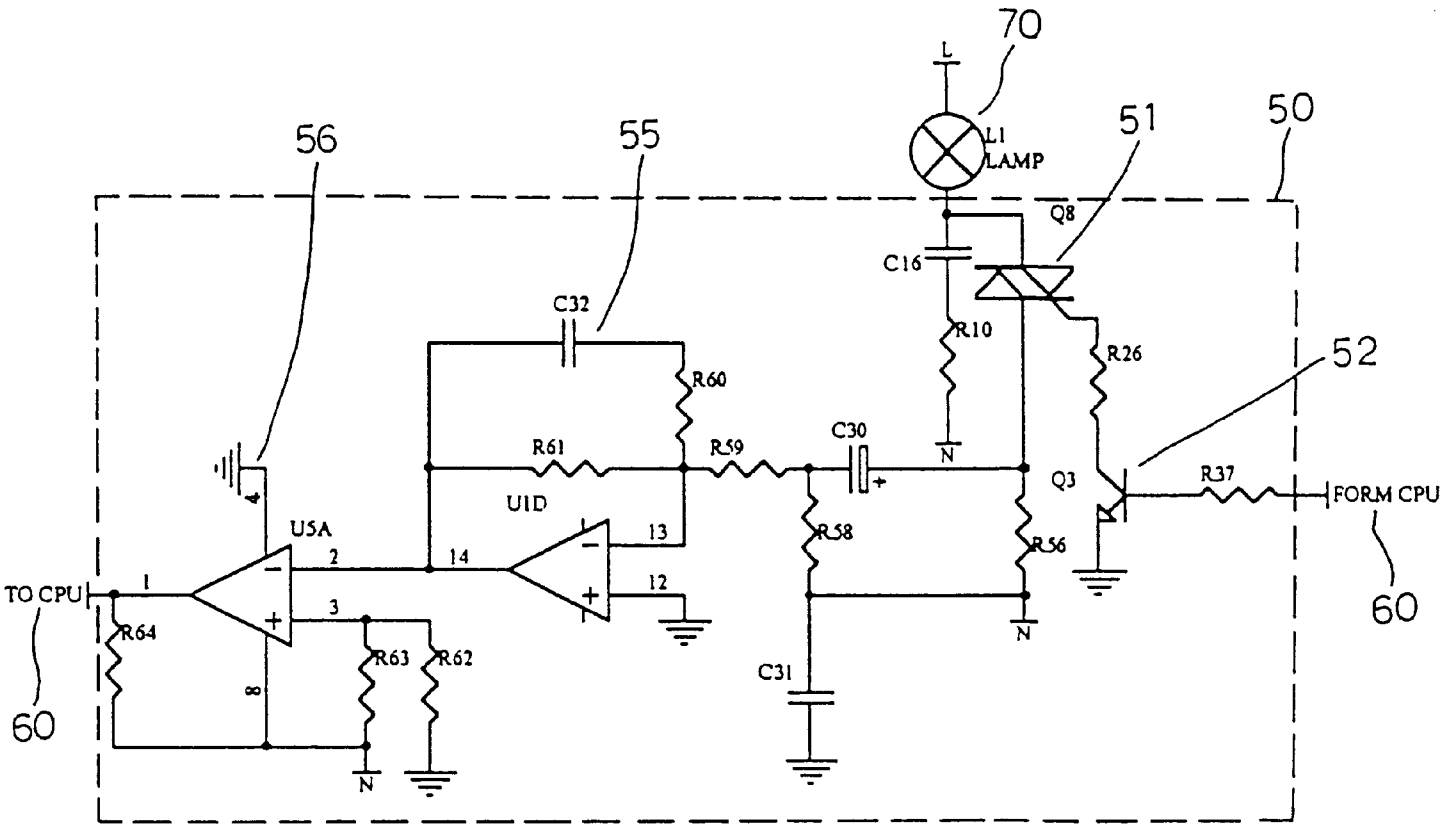
FIG. 2 is a circuit diagram of a light control for a ceiling fan and lamp assembly according to the present invention.

Referring to FIG. 2, a light control 50 is shown comprising a TRIAC 51, a transistor 52, an amplifier 55, and a comparator 56. The gate of the TRIAC 51 is connected to an output contact of the CPU, referenced by 60 through the transistor 52. A second terminal of the TRIAC 51 is connected to the load (lamp) 70. The other terminal, namely, the third terminal of the TRIAC 51 is connected to the inverter terminal of the amplifier 55 through resistors and capacitors. The output terminal of the amplifier 55 is connected to the inverter terminal of the comparator 56. The non-inverter terminal and output terminal of the comparator 56 form a feedback circuit, which is connected to an input contact of the CPU 60. When the TRIAC 51 is activated, a potential difference is produced, which is then amplified by the amplifier 55, and then compared with a predetermined reference value at the comparator 56. The comparison result is feedback to the CPU 60 through the feedback circuit of the non-inverter terminal and output terminal of the comparator 56, causing the CPU 60 to take the necessary action, for example to cut off power supply from the light control 50 when an overload or short-circuit occurred.

Figure 3:
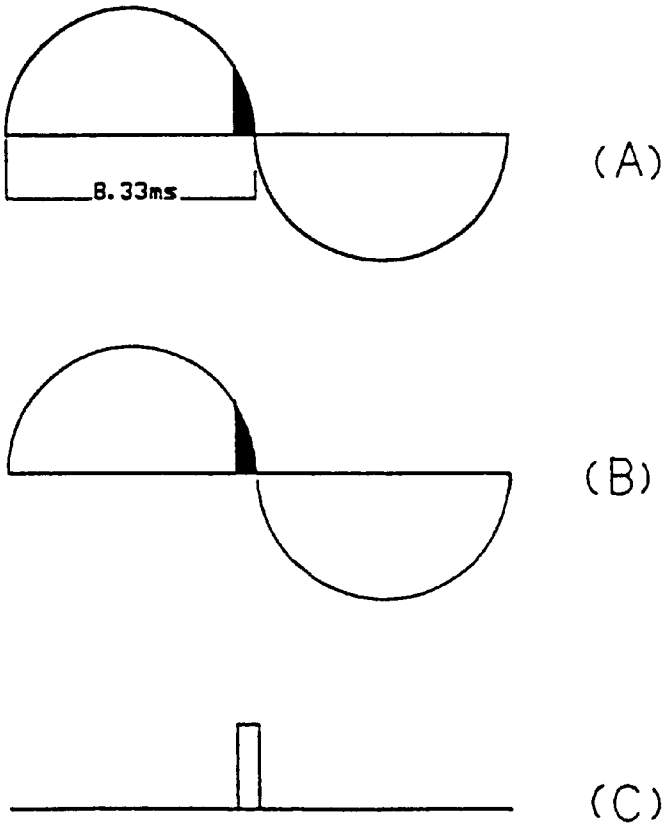
FIG. 3 illustrates variation of waveform from a residual waveform to a triggering waveform according to the present invention.

Referring to FIG. 3 and FIG. 2 again, the light control 50 uses the shadow portion of the residual waveform upon activation of the TRIAC 51 (see FIG. 3A) as time (about 150 ns) (see FIG. 3B) of commanding the CPU 60 to send a triggering waveform (see FIG. 3C) to the gate pin of the TRIAC 51, causing the TRIAC 51 to be electrically connected for same length of time. If the load surpasses the rated value or a short-circuit occurs at this time, a potential difference is obtained. This potential difference is then sent to the amplifier 55 for amplification, and then sent to the comparator 56 for comparison with the predetermined reference value, thereby causing a negative electricity output to be produced and fed back to the CPU 60. Upon receipt of the negative electricity output, the CPU 60 disconnects the TRIAC 51 before the negative half cycle, preventing the TRIAC 51 from possible damage.

As indicated above, the present invention provides a light control for a ceiling fan and lamp assembly, which comprises an overload/short-circuit protection circuit that automatically cuts off power supply from the load upon an overload or short-circuit.

What the invention claimed is:

1. A light control installed in a ceiling fan and lamp assembly and adapted to control the light intensity of lamp means of said ceiling fan and lamp assembly and to automatically cut off power supply from said ceiling fan and lamp assembly upon an overload or short-circuit, the light control comprising a CPU (central processing unit) having an input contact and an output contact, a TRIAC, a transistor, an amplifier, and a comparator, said TRIAC having a gate connected to the output contact of said CPU through said transistor, a second terminal connected to the lamp means of said ceiling fan and lamp assembly, and a third terminal connected to said amplifier, said amplifier having an output terminal connected to said comparator, said comparator having a feedback circuit outputted to the input contact of said CPU.

2. The light control of claim 1 wherein said TRIAC is connected to the inverter terminal of said amplifier, said amplifier has an output terminal connected to an inverter terminal of said comparator, and said comparator having a non-inverter terminal and an output terminal forming with the non-inverter terminal of said comparator.

* * * * *